United States Patent [19]

Gresens

[11] Patent Number: 4,706,348

[45] Date of Patent: Nov. 17, 1987

[54] TENSIONING CHAIN PROVIDED WITH GRIPPERS

[75] Inventor: Harry Gresens, Benningen, Fed. Rep. of Germany

[73] Assignee: Bruckner Trockentechnik GmbH & Co. KG, Leonberg, Fed. Rep. of Germany

[21] Appl. No.: 840,005

[22] Filed: Mar. 18, 1986

[30] Foreign Application Priority Data

Apr. 4, 1985 [DE] Fed. Rep. of Germany ..... 3512417

[51] Int. Cl.[4] ..... D06C 3/04

[52] U.S. Cl. ..... 26/93; 26/79

[58] Field of Search ..... 26/79, 89, 93, 94, 95

[56] References Cited

U.S. PATENT DOCUMENTS

| | | | |
|---|---|---|---|
| 655,205 | 8/1900 | Dana | 26/79 |
| 3,638,289 | 2/1972 | Dornier et al. | 26/93 |
| 4,134,189 | 1/1979 | Richter | 26/93 X |
| 4,602,407 | 7/1986 | Gresens | 26/89 |

FOREIGN PATENT DOCUMENTS

| | | | |
|---|---|---|---|
| 1801695 | 6/1970 | Fed. Rep. of Germany | 26/93 |
| 1191296 | 5/1970 | United Kingdom | 26/94 |

*Primary Examiner*—Robert R. Mackey
*Attorney, Agent, or Firm*—C. O. Marshall, Jr.

[57] ABSTRACT

The invention relates to a tensioning chain provided with grippers in which the gripper body is made from cast spheroidal graphite or high-grade cast steel, the arms for pivot mounting of the gripper flap run at an angle upwards, the angle between the two arms of the gripper flap is kept small and the ratio of length to diameter of the link pins is between 1:0.9 and 1:1.5. Such a gripper is distinguished in particular by a particularly low overall height.

1 Claim, 12 Drawing Figures

TENSIONING CHAIN PROVIDED WITH GRIPPERS

BACKGROUND OF THE INVENTION

The invention relates to a tensioning chain provided with grippers (particularly for textile machinery).

In the previously known constructions, the grippers have generally been made from aluminium. The arms provided on the gripper body for pivot mounting of the gripper flap run horizontally from their attachment point to their outer end which forms the pivot mounting point. In addition, the angle between the two arms of the gripper flap is such that in the open position, the actuating arm projects over the upper edge of the gripper body by such a distance that this actuating arm can be pushed into the closed position by contact with a control surface.

Because of the constructional features referred to above, the known gripper has an overall height which is undesirably great for many applications. The link pins in the known gripper chain have a ratio of length to diameter of the order of approximately 2:1.

A reduction in the overall height of the known gripper is desirable for various reasons. For instance, the minimum spacing to be maintained for nozzles for the hot air treatment of a length of material transported by means of the tensioning chain depends upon the overall height of the gripper.

The object of the invention, therefore, is to construct a tensioning chain in such a way as to produce a substantial reduction in the overall height of the gripper. At the same time, it should be ensured that even in the open state the gripper flap does not project over the profile of the gripper body so that return transport of the chain with open gripper flaps is possible.

SUMMARY OF THE INVENTION

According to the invention, the gripper body is produced from cast spheroidal graphite or high-grade case steel, i.e. from a particularly strong material. When a high-grade steel spindle is used for the gripper flap, the resulting pairing of materials constitutes a highly durable sliding bearing. The choice of the said high-grade material for the gripper body also constitutes a first essential prerequisite for the desired reduction in the overall height.

According to the invention, the arms provided on the gripper body for pivot mounting of the gripper flap run from their attachment point at an angle upwards towards their outer end forming the pivot mounting point, so that the latter is a greater distance from the plane of the gripper table than is the attachment point. In this way, a free space is created above the inclined arms into which a control device for actuating the gripper flap can project.

The angle between the two arms of the gripper flap is kept so small according to the invention that in the open position the actuating arm does not project over the upper edge of the gripper body, In this way, return transport of the chain is possible with the gripper flaps open without the gripper flaps projecting upwards over the maximum profile of the gripper body.

The reduction in the overall height of the gripper results in a shortening of the length of the link pins. In order, nevertheless, to keep the surface pressures in the articulation point as small as possible and thereby to increase the durability of the sliding bearing bushing which engages with the link pin, according to the invention, the link pin is constructed with an extremely large diameter. The ratio of length to diameter of the link pins is advantageously between 1:0.9 and 1:1.5, preferably between 1:1.1 and 1:1.3.

DESCRIPTION OF THE PREFERRED EMBODIMENTS

Figure 1:
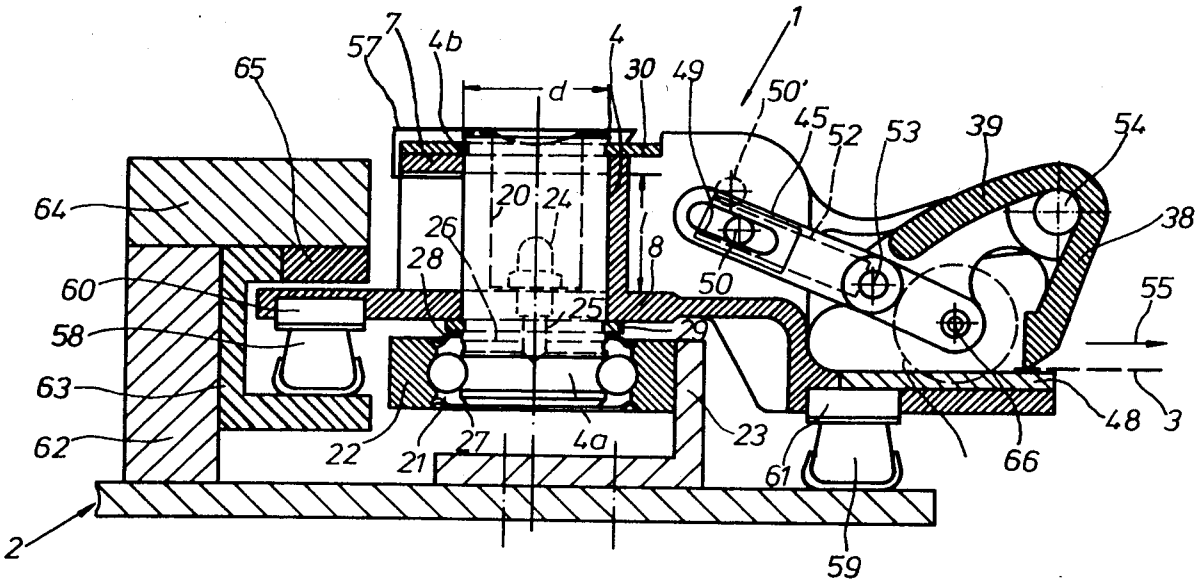
FIG. 1 shows a section (viewed in the longitudinal axis of the chain) of a gripper in a rolling construction.

The gripper 1 shown in FIG. 1 is a part of a tensioning chain which moves along a stationary guide 2 at right angles to the drawing plane. The length of material 3 gripped by the gripper is indicated by broken lines.

The tensioning chain consists of a plurality of similar grippers 1 which are connected to one another by link pins 4 and fishplates.

Figure 2:
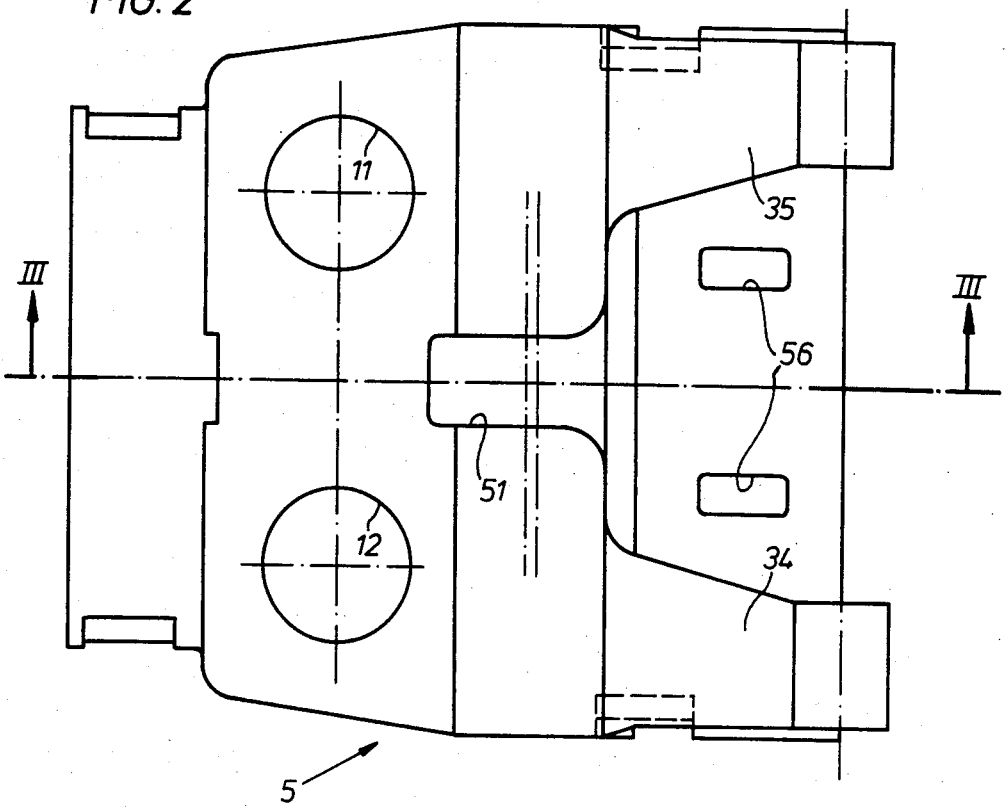
FIG. 2 shows a plan view of the gripper body of the gripper according to FIG. 1.
Figure 3:
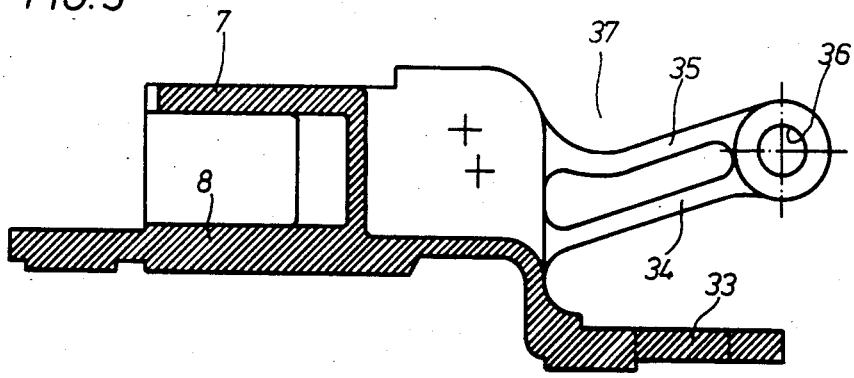
FIG. 3 shows a section through the gripper body along the line III—III in FIG. 2.
Figure 4:
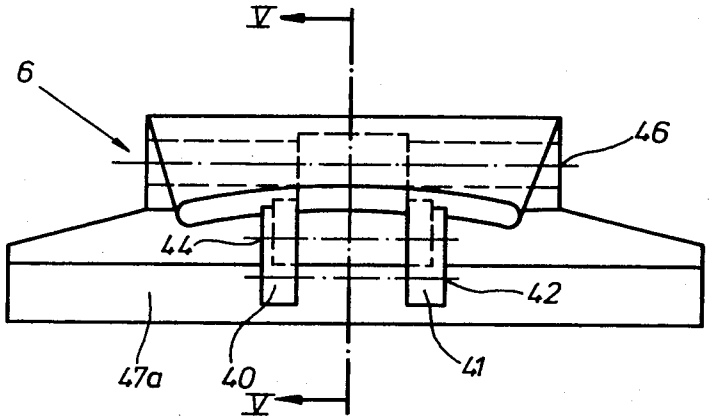
FIG. 4 shows a view of the gripper flap from below.
Figure 5:
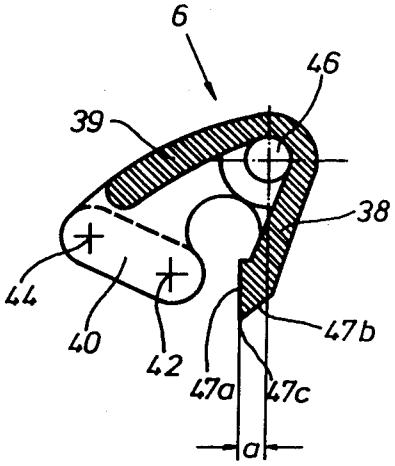
FIG. 5 shows a section through the gripper flap along the line V—V in FIG. 4.

The gripper 1 consists essentially of a gripper body 5, which is illustrated in detail in FIGS. 2 and 3, and a gripper flap 6, the details of which can be seen in FIGS. 4 and 5.

Figure 6:
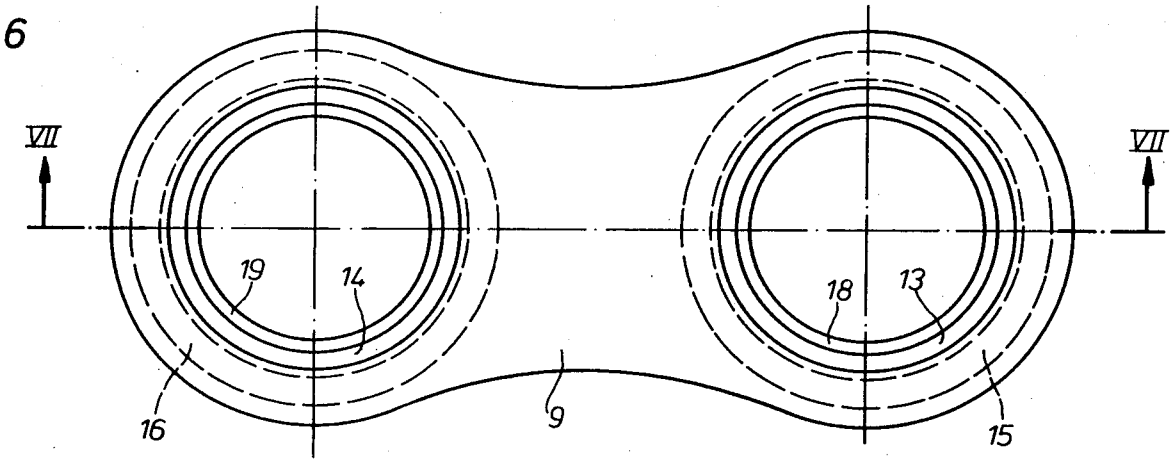
FIG. 6 shows a plan view of a pair of inner fishplates.
Figure 7:
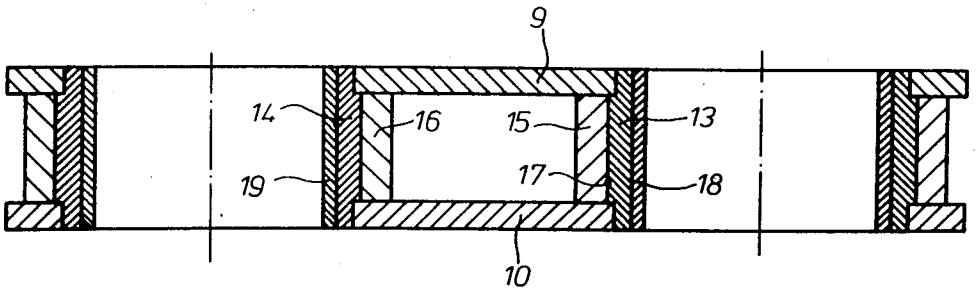
FIG. 7 shows a section through the pair of inner fishplates along the line VII—VII in FIG. 6.

The gripper body 5 has two surfaces 7, 8 which form a pair of outer fishplates between which the two inner fishplates 9 and 10 of a pair of inner fishplates illustrated in FIGS. 6 and 7 engage (for reasons of clarity the pair of inner fishplates formed by the inner fishplates 9, 10 is not shown in FIG. 1). The surfaces 7 and 8 of the gripper body 5 which form the outer fishplates are provided with bores 11, 12 to receive the link pins 4.

The two inner fishplates 9, 10 of a pair of inner fishplates are made from steel and are firmly connected to one another in the region of each of the two articulation points by a chain bushing 13, 14 which is pressed in. A protecting roller 15, 16 is arranged so as to be rotatable on the chain bushings 13, 14 with lubricating paint 17 in between. When the chain runs into the sprocket wheel the protecting rollers 15, 16 carry out a limited rotary movement. Since this movement is small, the sliding surface between the chain bushing 13, 14 and the protecting roller 15, 16 can be sufficiently lubricated for its lifetime by lubricating paint 17. A sliding bearing bushing 18, 19 is also arranged in the chain bushings 13, 14, respectively.

As can be seen from FIG. 1, the link pin 4 is hollow drilled, i.e. is provided with a recess 20 which is open towards the top.

The lower end 4*a* of the link pin 4 forms the inner ring of a ball bearing 21, the outer ring 22 of which is formed by a roller which engages with a rail 23 of the stationary guide 2.

From the base of the recess 20 in the link pin 4 a short axial bore 25 provided with a grease nipple 24 and a connecting cross bore 26 leads into the interior of the ball bearing 21. This construction results in very short channels for further lubrication of the ball bearing so that dead grease, i.e. grease not participating in the lubrication, is only present in quite a small quantity.

The interior of the ball bearing 21 is sealed towards the bottom by a circular cover 27 and towards the top by an annular cover 28. The annular cover 28 forms a small gap with the link pin 4. This sealing of the ball bearing 21 ensures that grease losses, particularly downwards, cannot occur.

If the diameter of the link pin 4 is designated by d and the length of the pin between the undersides of the surfaces 7 and 8 of the gripper body 5 (i.e. the height of the chain bushings 13, 14 according to FIG. 7) which is decisive for the surface pressure in the joint is designated by 1, then the ratio of length 1 to diameter d of the link pin 4 in the illustrated embodiment is approximately 1:1.2.

Figure 8:
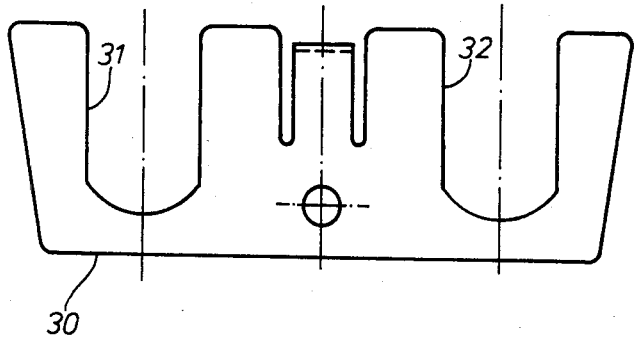
FIG. 8 shows a plan view of a spring steel plate serving to secure the link pins.

Above the ball bearing 21, the link pin 4 has a ring 29 placed on it which rests against the underside of the surface 8 of the gripper body 5. In order to secure the link pin 4 in the gripper body 5, a spring steel plate 30 is provided, the shape of which can be seen from FIG. 8. It contains two recesses 31, 32 which are open towards the front with their parallel side edges coming into engagement with lateral flat grooves 4b in the link pins 4. In this way, the link pin 4 is on the one hand secured against axial movement by the spring steel plate 30 and the ring 29 and on the other hand prevented from rotating relative to the gripper body 5 by the spring steel plate 30.

Figure 9:
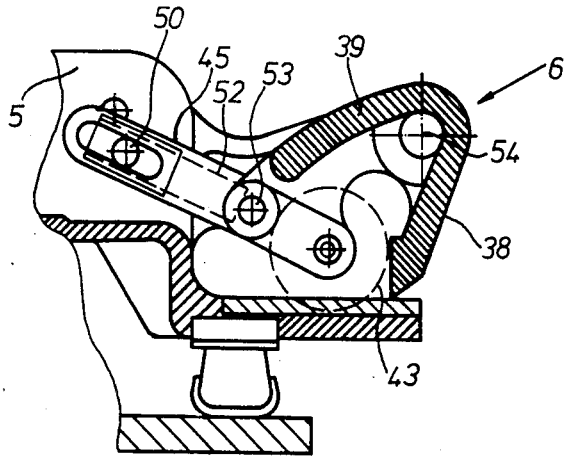
FIGS. 9, 10 and 11 show schematic representations for explaining the function of the pressure spring in the open and closed position of the gripper flap.

In addition to the two previously mentioned surfaces 7, 8 which form the outer fishplates, the gripper body 5 which is made from cast spheroidal graphite or high-grade cast steel contains an arm 33 and two arms 34, 35 for pivot mounting of the gripper flap 6. The arms 34, 35 run a an angle upwards from their attachment point on the main part of the gripper body 5 to their outer end which forms the pivot mounting point (bore 36, FIG. 3) so that the said outer end is a greater distance away from the plane of the arm 33 than is the attachment point. This produces a free space 37 above the arms 34, 35 into which a control device for actuating the gripper flap can project (as is clear from the description of FIGS. 9 to 11).

The gripper flap 6 which is shown in detail in FIGS. 4 and 5 is made in one piece from a hardenable high quality refined steel casting. It is essentially constructed as a two-armed angle lever and contains an arm 38 which forms the gripper blade and an actuating arm 39. In addition, two bars 40, 41 which receive the spindle of a feeler roller 43 (cf. FIG. 1) in a bore 42 are provided on the underside of the gripper flap 6. A further bore 44 in the bars 40, 41 serves to receive a spindle by means of which a spring housing 45 is pivotally articulated on the gripper flap 6.

The gripper flap 6 is produced as follows: after casting the gripper flap 6 is first of all hardened in the region of the blade edge (lower end of the arm 38). Then the pivot mounting bore 46 is made. For further work, the gripper flap 6 is then accommodated in the pivot mounting bore 46 which has been produced.

Next the vertical blade surface 47*a* is ground and then the inclined blade surface 47*b* is ground specifically oversize. Finally, by grinding a chamfer 47*c*, the exact distance a between the axis of the pivot mounting bore 46 and the blade edge (chamfer 47*c*) is set.

In the production of the gripper body 5, the exact distance between the axis of the bore 36 and the gripper table is set in a corresponding manner. The gripper table 48 consists of a flat steel plate which is, for example, 3 mm thick, is supported by the arm 33 of the gripper body 5, mounted thereon by means of tubular rivets and then machined. The machining takes account of the absolute parallelism of the axis to the bore 36 (pivot mounting axis for the gripper flap 6).

The spring housing 45 provided between the gripper body 5 and the actuating arm 39 of the gripper flap 6 has on its end facing the gripper body a slot 49 with which it is guided on a bearing pin 50 provided on the gripper body 5. As can be seen from FIG. 2, the gripper body 5 is provided with a recess 51 to accommodate the spring housing 45.

Bores are provided in two different positions in the gripper body 5 for the bearing pin 50 so that the bearing pin 50 can either take up the position shown in FIG. 1 by solid lines or the position by broken lines (50'). The difference in function resulting from this is explained in detail with the aid of FIGS. 9 to 11.

In the spring housing 45, a pressure spring 52 is provided which is supported on the one hand on the bearing pin 50 and on the other hand on the bearing pin 53 by means of which the spring housing 45 is articulated on the actuating arm 39 of the gripper flap 6.

Figure 11:
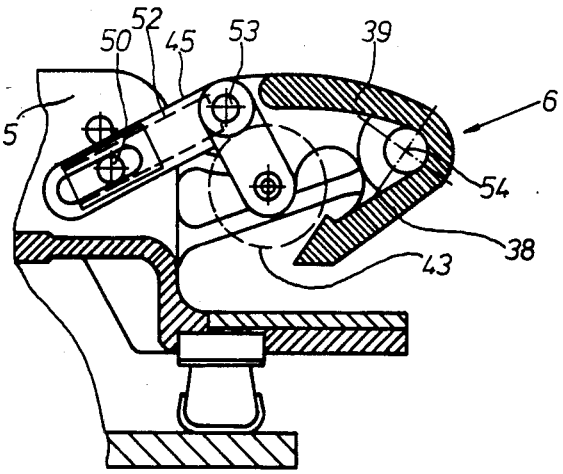

The length of the pressure spring 52 and the distance between the two bearing pins 50, 53 is such that the pressure spring 52 holds the gripper flap 6 in the open position under spring tension. This position is illustrated in FIG. 11. If, for example, the pressure spring 52 has a spring length of 19 mm (in the uncompressed state), then in the position according to FIG. 11, the pressure spring has a length for example of 17 mm. In the position according to FIG. 11, the return transport of the chain can take place, and the gripper flap 6 in the open position does not project over the upper edge of the gripper body 5.

Figure 10:
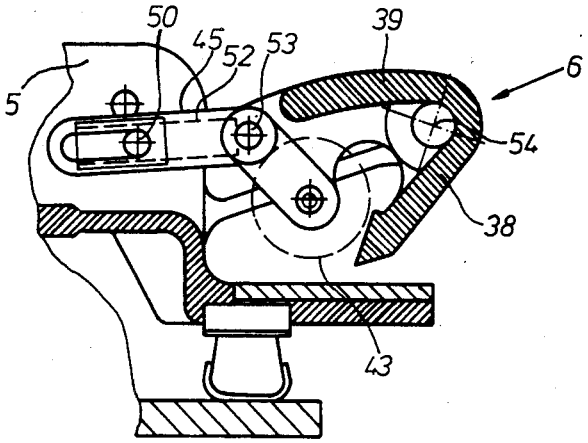

If the actuating arm 39 of the gripper flap 6 is pushed downwards by a control device so that the gripper flap 6 carries out a pivoting movement counter-clockwise about the axis of the pivot mounting pin 54, the pressure spring 52 is initially further compressed so that in the intermediate position illustrated in FIG. 10, it has a spring length for example of 14 mm. In the closed position (FIG. 9), the pressure spring then has a length for example of 18 mm, so that the gripper flap 6 is guided into the closed position by spring tension and held there. With this dimensioning of the pressure spring and the arrangement of the bearing pin 50 in the position illustrated by solid lines, the gripper flap 6 is thus guided into the closed position by sprinig tension.

It might also be desired to provide a function as "feeling gripper". For this, when the gripper flap is not completely closed, the feeler roller 43 initially rests on the length of material 3 and is drawn outwards by the latter (i.e. in the direction of the arrow 55 according to FIG. 1). If the edge of the length of material 3 then moves under the feeler roller 43, the feeler roller 43 drops downwards (into the recesses 56 in the gripper table or in the arm 33 which can be seen in FIG. 2) so that the gripper flap 6 falls into the closed position. With this function as "feeling gripper", the gripper flap 6 should not be subjected to any spring tension in the last part of the closing movement.

In order to achieve this in an otherwise unchanged construction, the bearing pin 50 is aranged in the position 50' indicated by broken lines. If the hypothetical pressure spring having a spring length of 19 mm (in the uncompressed state) which was used in the above example is used as a basis here, then in the open position of the gripper flap the pressure spring again has a spring length of 17 mm (so that here too the gripper flap is held in the open position by spring tension). In the closed position (corresponding to FIG. 9), on the other hand, the distance between the bearing pin 53 and the bearing pin 50 located in the position 50' is now approximately 23 mm. Therefore in the closed position of the gripper flap, the spring (having a length of 19 mm) lies completely decompressed with some clearance between the two bearing pins.

In order to prevent the penetration of fibers and other contaminants into the recess 20 in the link pin 4, an additional spring plate 57 is provided in the embodiment according to FIG. 1.

Fixed carbon rails 58, 59, on which the gripper body 5 is supported with snap-on steel springs 60, 61 serve for guiding and vertical support of the gripper chain according to FIG. 1. The chosen geometry of the chain rail and the chain makes it possible to use 10 mm high carbons. For this reason, impregnated synthetic carbons cannot be used.

The travel path of the chain is defined to the rear by a key steel 62 onto which a brass profile 63 is screwed. This brass profile 63 on the one hand supports the carbon rail 58 and on the other hand serves to support the chain in case it is not drawn onto the rail 23 by material tension. It must be accepted that the grippers sometimes dip into the chain rail, i.e. start at the rear. Because of the chosen pairing of materials (case speroidal graphite or high-grade cast steel for the gripper body, brass for the profile 63), such reverse movement is not critical.

If the chain has to be secured at the links against lifting, an additional key steel 64 can be screwed onto the said key steel 62 so that it lies horizontally at the critical points, producing a contact surface for a supporting plastic element 65. The rigidity of the overall construction is achieved by the selection of correspondingly strong profiles. Lifting of the chain is thus reliably prevented in this way.

The feeler roller 43 is produced from aluminium which is chemically oxidised so that an extraordinarily hard surface is produced. The feeler roller 43 is mounted by means of a trunnion screw 66 (possibly with a sliding bearing bushing).

Figure 12:
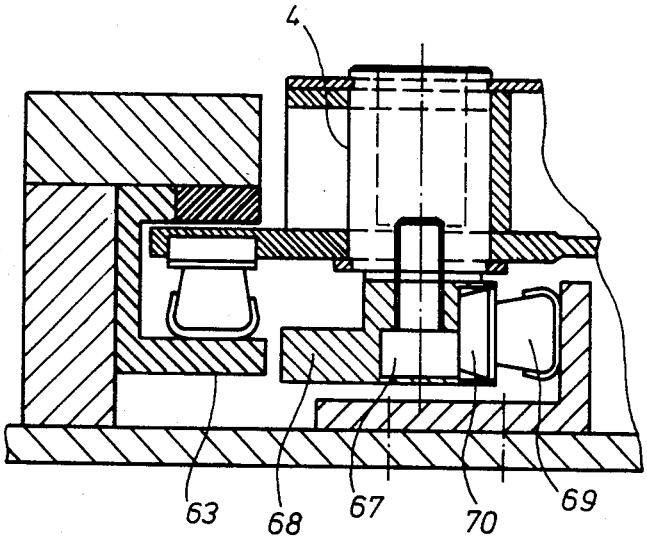
FIG. 12 shows a section (corresponding to FIG. 1) through a gripper in a sliding construction.

FIG. 12 shows a detail of a gripper in a sliding construction. A slide shoe 68, which on the one hand carries the material tension to an additionally arranged carbon rail 69 (via a steel spring 70) and on the other hand is constructed so that it can support the chain against the brass profile 63 arranged there when the gripper dips into the chain rail (i.e. when the gripper moves to the left), is mounted on the lower end of the link pin 4 by means of a screw 67.

The gripper according to the invention is distinguished not only by its overall height which is substantially reduced by comparison with known constructions, but also has a number of other significant advantages. For instance, the gripper can be used at up to approximately 300° C. without loss of efficiency; it can also be used in processes working with substances which are not neutral (acid or basic).

The chain is suitable for sliding or rolling removal of tension, and the sliding surfaces of the chain are made from standard carbons.

Because of the described production of the gripper body and the gripper flap, interchangeability of the gripper flap is possible (ensuring continuously exact closure conditions).

Grease losses during further lubrication are avoided by the small grease paths in the link pins.

The gripper permits working speeds up to approximately 300 m/min. Ball bearings have a sufficiently large diameter so that because of the life of the grease used for lubrication, speeds of approximately 2000 r.p.m. are not exceeded.

The feeler roller 43 can be made from plastic, brass or high-grade steel instead of aluminium.

The bearing bore 36 (FIG. 3) can also be provided with a sliding bearing bushing in order to prevent the formation of rust from vibration.

I claim:

1. A tensioning chain consisting of a plurality of grippers which are flexibly connected to one another by means of link pins and fishplates, each gripper containing a gripper body having two arms on which a gripper flap is pivotally mounted and is movable between an open position and a closed position, the gripper body also containing a gripper table, the gripper flap being constructed as an angle lever having two arms, one of which forms a gripper blade, characterized in that the gripper body is made of a material of the class consisting of cast spheroidal graphite and high-grade cast steel, the arms of the gripper body extending upward from the gripper body at an angle whereby the point at which the gripper flap is pivoted is spaced above the gripper table, the angle between the two arms of the gripper flap being small enough so that the other arm of the gripper flap does not project above the gripper body in the open position, the ratio of the length to the diameter of each link pin being between 1:0.9 and 1:1.5, a bearing pin on the other arm of the gripper flap being pivoted to a housing which has a slot which receives a bearing pin on the gripper body, and a spring in said housing which acts upon the two bearing pins to hold the flap both in its open and in its closed position.

* * * * *